US011085205B2

(12) United States Patent
Colligan

(10) Patent No.: US 11,085,205 B2
(45) Date of Patent: Aug. 10, 2021

(54) SLIDING DOOR LOCKING SYSTEM

(71) Applicant: Accurate Lock & Hardware Co. LLC, Stamford, CT (US)

(72) Inventor: Francis Colligan, New Haven, CT (US)

(73) Assignee: Accurate Lock & Hardware Co. LLC, Stamford, CT (US)

( * ) Notice: Subject to any disclaimer, the term of this patent is extended or adjusted under 35 U.S.C. 154(b) by 437 days.

(21) Appl. No.: 16/201,347

(22) Filed: Nov. 27, 2018

(65) Prior Publication Data

US 2019/0161992 A1 May 30, 2019

Related U.S. Application Data

(60) Provisional application No. 62/591,467, filed on Nov. 28, 2017.

(51) Int. Cl.
*E05B 65/08* (2006.01)
*E06B 3/46* (2006.01)
(Continued)

(52) U.S. Cl.
CPC ..... *E05B 65/0817* (2013.01); *E05B 15/0205* (2013.01); *E05B 63/12* (2013.01); *E05B 65/0835* (2013.01); *E05F 5/003* (2013.01); *E06B 3/4636* (2013.01); *E05Y 2900/132* (2013.01); *Y10S 292/46* (2013.01)

(58) Field of Classification Search
CPC ..... E05B 65/0817; E05B 65/0835; E05B 65/0811; E05B 65/0864; E05B 3/4636; Y10S 292/46; E05F 5/003
See application file for complete search history.

(56) References Cited

U.S. PATENT DOCUMENTS 2,764,442 A 9/1956 Weaver
4,513,535 A 4/1985 Uphoff
(Continued)

FOREIGN PATENT DOCUMENTS

DE 102010019917 A1 11/2011
EP 2248977 A2 11/2010

OTHER PUBLICATIONS

Barn Door Privacy Locks; hangingdoorhardware.com; retrieved Jul. 3, 2017 from: http://hangingdoorhardware.com/pocketdoors/barn_door_track/barn_door_locks.html.

*Primary Examiner* — Justin B Rephann
(74) *Attorney, Agent, or Firm* — Forge IP, PLLC

(57) ABSTRACT

A sliding door locking system includes a sliding door having an inner surface that slides over a doorway opening when the door is slidably mounted above the doorway opening, and an outer surface. A lock housing is mounted in the sliding door, the housing having an aperture extending through the inner surface of the sliding door. A latch is hingedly mounted in the aperture such that the latch is moveable from a retracted position, in which the door is slidable along the door opening, and an extended position, in which the latch engages a catch opposite the inner surface of the door and adjacent the doorway opening. At least one of the inner and outer surfaces of the sliding door includes an actuator that, when moved from a first position to a second position, moves the latch from the retracted position to the extended position.

25 Claims, 14 Drawing Sheets

(51) Int. Cl.

| | |
|---|---|
| ***E05B 15/02*** | (2006.01) |
| ***E05F 5/00*** | (2017.01) |
| ***E05B 63/12*** | (2006.01) |

(56) References Cited

U.S. PATENT DOCUMENTS

| | | | | |
|---|---|---|---|---|
| 4,872,287 | A | 10/1989 | Block | |
| 5,203,596 | A * | 4/1993 | Stevens | E05B 65/0841 292/204 |
| 5,595,409 | A * | 1/1997 | Fier | E05B 17/042 292/112 |
| 6,264,252 | B1 * | 7/2001 | Clancy | E05B 65/0858 292/123 |
| 6,983,512 | B2 | 1/2006 | De Oliveira | |
| 7,942,027 | B1 | 5/2011 | Cassini | |
| 8,061,165 | B1 * | 11/2011 | Cassini | E05B 63/16 70/99 |
| 8,096,593 | B2 | 1/2012 | Gibbons | |
| 8,112,954 | B2 | 2/2012 | Gosling et al. | |
| 8,915,019 | B2 | 12/2014 | Schachter et al. | |
| 9,027,283 | B2 | 5/2015 | Beyerle | |
| 9,103,134 | B1 | 8/2015 | Murray et al. | |
| 9,644,420 | B1 * | 5/2017 | Larimore | E06B 5/10 |
| 2006/0000147 | A1 | 1/2006 | Pieper | |
| 2006/0080912 | A1 * | 4/2006 | Shedd | E05C 9/042 52/204.1 |
| 2006/0192394 | A1 * | 8/2006 | Cennamo, Jr. | E05B 15/02 292/139 |
| 2009/0212578 | A1 * | 8/2009 | Gibbons | E05B 65/0852 292/262 |
| 2010/0164237 | A1 * | 7/2010 | Brandt | A01K 1/0017 292/219 |
| 2011/0163555 | A1 | 7/2011 | Watts et al. | |
| 2012/0006081 | A1 * | 1/2012 | Tan | E05B 65/0835 70/95 |
| 2017/0275916 | A1 * | 9/2017 | Chaffin | E05D 15/565 |
| 2018/0094464 | A1 * | 4/2018 | Allen | E05B 53/00 |
| 2018/0112435 | A1 * | 4/2018 | Cheng | E05B 17/2069 |
| 2019/0024407 | A1 * | 1/2019 | Cheng | E05B 15/029 |
| 2019/0106909 | A1 * | 4/2019 | Wright | E05C 17/48 |
| 2019/0301204 | A1 * | 10/2019 | Odom | E05B 15/0205 |

* cited by examiner

SLIDING DOOR LOCKING SYSTEM

FIELD OF THE INVENTION

The present invention relates to door locks, and more specifically, to a door lock assembly for barn doors and other surface-mounted sliding doors.

BACKGROUND OF THE INVENTION

Surface-mounted sliding doors are used in a number of different applications, such as on barns and other buildings. Barn style doors are becoming increasingly popular as interior doors within homes, offices, hotels, and the like. Barn doors generally hang from and slide along a track mounted above the door frame. In many cases, the bottom of the door is not attached to a track, and thus, the top of the door is able to pivot about the top track such that the bottom of the door swings outwardly.

Being surface mounted, and in some cases, able to swing outwardly and upwardly away from the floor surface, makes it difficult to latch and lock barn and similarly mounted doors. The lack of security and privacy resulting from the fact that the sliding door can still be opened by swinging the bottom of the door upwardly is undesirable. Additionally, if the sliding door is mounted via wheels or another type of sliding apparatus that is easily decoupled from the track, this swinging of the door can cause the door to derail, potentially causing injury or inconvenience.

U.S. Pat. No. 9,103,134 to Murray et al. discloses a sliding privacy door. The travel path of the door can be limited by door stop pins or brackets. A plunger lock is used to lock the door in a closed position between a door stop and the edge of the pane/panel frame. However, while the plunger lock may inhibit sliding, it does not prevent the door from swinging outwardly.

Typically, barn and other sliding doors of this type have no means to actually latch the door closed such that it prevents the bottom of the door from having this outwardly swinging motion. Because they are surface-mounted and therefore do not have an edge that mates with a door frame, traditional door latches are not suitable for this purpose. However, sliding barn doors overlap the edges of a door opening, typically by at least three inches on each side. This additional door area is typically not used for anything other than to create the overlap, resulting in a waste of space that could also be used for a locking system to help secure the door in place.

What is desired, therefore, is a system for locking a surface-mounted door when the door is closed. What is further desired is a locking system that prevents a surface-mounted sliding door from swinging outwardly, thereby providing enhanced reliability and a lower chance of accidental injury. What is also desired is a locking system that utilizes the otherwise unused area of a door that overlaps with the edges of the doorway opening when the door is closed.

SUMMARY OF THE INVENTION

Accordingly, it is an object of the present invention to provide a locking assembly for a barn or other sliding door.

It is another object of the invention to provide a door locking assembly that prevents the bottom of the door from swinging outwardly.

It is still another object of the invention that locking assembly that uses the area of the door that overlaps with the edge of the doorway opening.

In order to overcome the deficiencies of the prior art and to achieve at least some of the objects and advantages listed, the invention comprises a sliding door locking system, including a sliding door having an inner surface that slides over a doorway opening when the door is slidably mounted above the doorway opening and an outer surface, a lock housing mounted in the sliding door, the housing having an aperture extending through the inner surface of the sliding door, and a latch hingedly mounted in the aperture such that the latch is moveable from a retracted position, in which the door is slidable along the door opening, and an extended position, in which the latch engages a catch opposite the inner surface of the door and adjacent the doorway opening. At least one of the inner and outer surfaces of the sliding door includes an actuator that, when moved from a first position to a second position, moves the latch from the retracted position to the extended position.

In some embodiments, the latch has a distal end that engages the catch, the distal end having a distal width, and the catch has an opening with a first section having a first width not less than the distal width, through which the distal end of the latch enters the catch as the latch is moved from the retracted position to the extended position, and a second section with a second width less than the distal width, which retains the distal end of the latch in the catch when the latch is in the extended position.

In some of these embodiments, the latch has a main portion proximal of the distal portion, the main portion having a main width less than the distal width, at least part of the catch opening is tapered, and the main portion of the latch passes through the tapered portion of the catch opening as the latch moves from the retracted position to the extended position.

In certain embodiments, the distal portion has a top and a bottom, a first cylinder extending from the top, and a second cylinder extending from the bottom.

In certain advantageous embodiments, the latch has a proximal end within the lock housing and a distal end that engages the catch, and when the latch moves from the retracted position to the extended position, the proximal end moves in a first lateral direction while the latch pivots about the proximal end such that the distal end moves in a second lateral direction opposite the first lateral direction.

In certain embodiments, the system further includes a slider disposed in the lock housing and movable relative thereto, and the latch has a proximal end hingedly coupled to the slider and a distal end that engages the catch. In some of these embodiments, the actuator is mechanically linked to the slider such that the slider moves the latch from the retracted position to the extended position when the actuator is moved from the first position to the second position.

In certain embodiments, the latch has an inclined surface that slides on an edge of the aperture.

In some embodiments, the housing includes an end plate perpendicular to the inner surface, and the latch has a distal end that does not extend out from the inner surface farther than the end plate when the latch is in the extended position.

In certain embodiments, the actuator comprises a thumb turn. In other embodiments, the actuator comprises a T-turn. In still other embodiments, the actuator comprises a sliding member.

In certain advantageous embodiments, the invention further includes a door stop that prevents the door from sliding at a distance at which the latch and the catch are aligned with each other.

In another embodiment, the invention comprises a sliding door locking system, including a lock housing having an aperture therein, the lock housing configured to be mounted in a sliding door such that the aperture extends through an inner surface of the sliding door, a latch hingedly mounted in the aperture such that the latch moves between a retracted position and an extended position, a catch configured to be mounted in a surface opposite the aperture of the lock housing such that the latch engages the catch when moved from the retracted position to the extended position, and an actuator configured to be mounted to at least one of an inner and outer surface of a sliding door such that the actuator, when moved from a first position to a second position, moves the latch from the retracted position to the extended position.

Other objects of the invention and its particular features and advantages will become more apparent from consideration of the following drawings and accompanying detailed description.

DETAILED DESCRIPTION OF THE INVENTION

The following detailed description illustrates the technology by way of example, not by way of limitation, of the principles of the invention. This description will enable one skilled in the art to make and use the technology, and describes several embodiments, adaptations, variations, alternatives and uses of the invention, including what is presently believed to be the best mode of carrying out the invention. One skilled in the art will recognize alternative variations and arrangements, and the present technology is not limited to those embodiments described hereafter.

Figure 1:
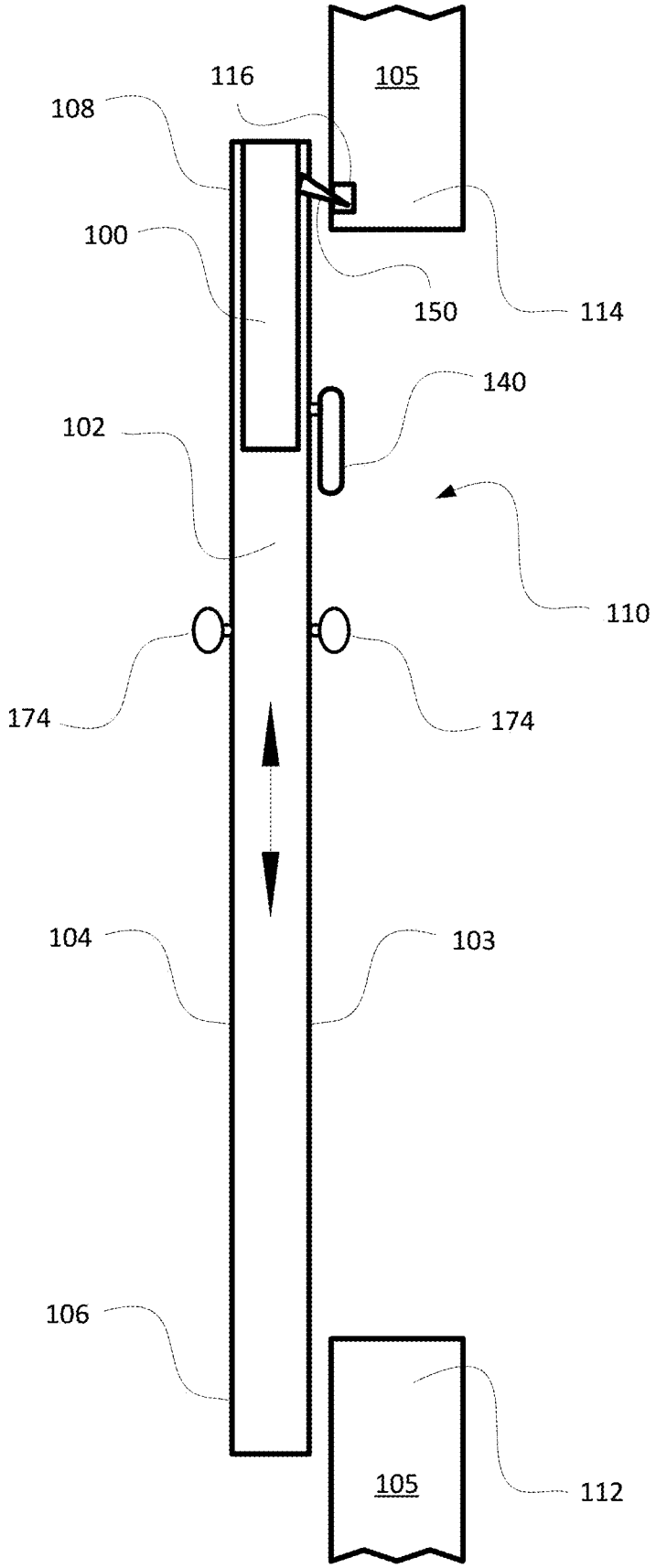
FIG. 1 is a top, exposed view of a sliding door locking system in accordance with the invention.
Figure 2:
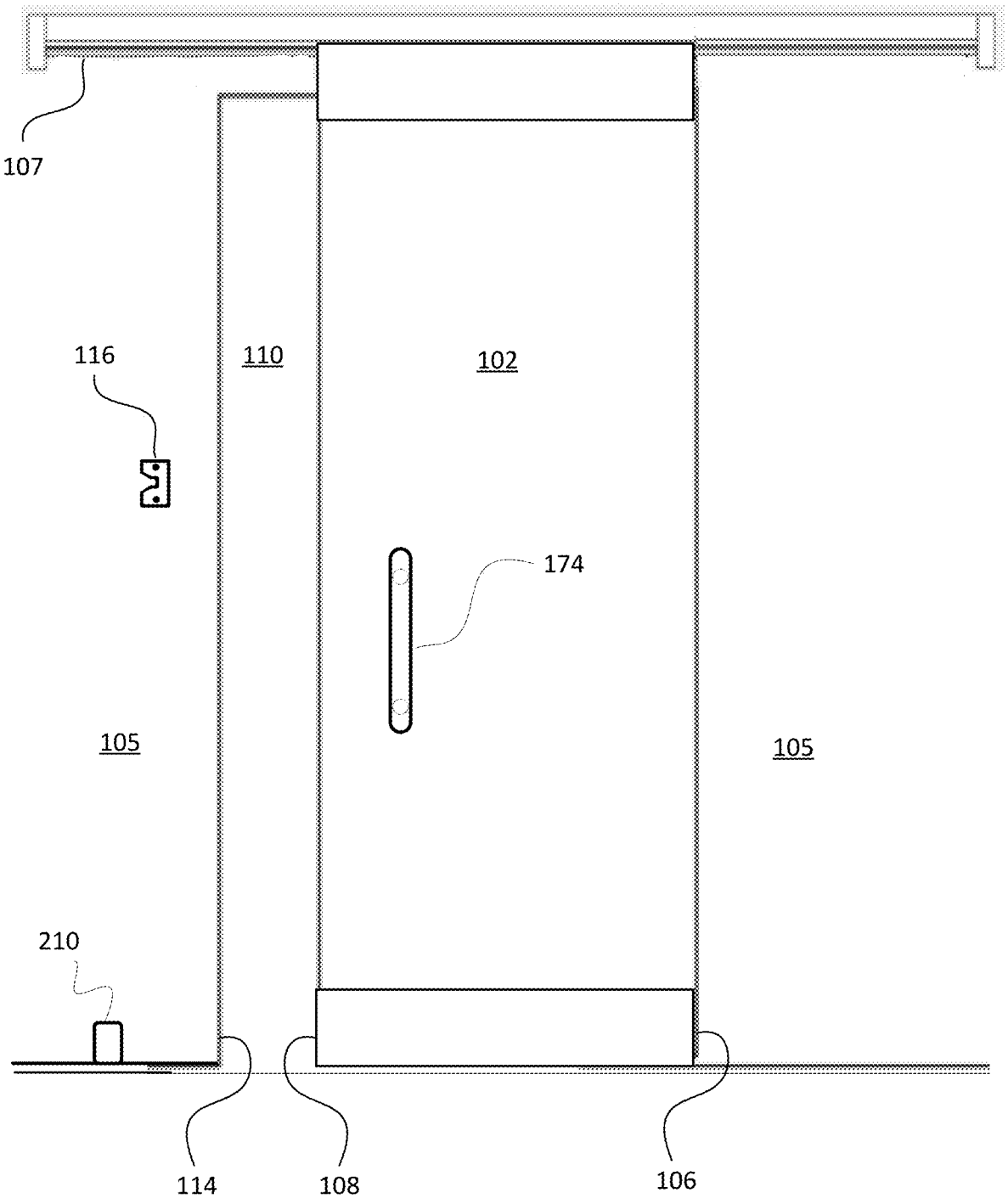
FIG. 2 is a side view of the sliding door locking system of FIG. 1.

FIGS. 1-2 illustrate one exemplary embodiment of a sliding door locking system in accordance with the invention. FIG. 1 shows a top cutaway view of a sliding door (102), such as a barn door. The door includes a first end or edge (106) and a second end or edge (108), and further includes a lock assembly (100) according to one exemplary embodiment of the invention. In this exemplary embodiment, a substantial portion of the assembly (100) is mounted within the door (102), as with a standard mortise style door lock assembly, adjacent the second end (108) of the door.

The sliding door (102) has an inner surface (103) and an outer surface (104). As shown in FIG. 2, the sliding door (102) is surface mounted to an existing structure, such as a standard interior wall (105), typically by hanging the door from an elevated track (107) above a doorway opening (110), such that the door moves along the track (107) via sliders, wheels, or other sliding mechanism.

The doorway opening (110) has a first side or edge (112) and a second side or edge (114). The door (102) slides back and forth along the track (107), such that the inner surface (103) slides over the doorway opening (110) and closes when the second end (108) of the door (102) overlaps the second side (114) of the opening (110). In the illustrated embodiment, the second side (114) is an edge of the wall (105) adjacent the opening (110). However, in other embodiments, the second side (114) may be an end of another sliding door. In some embodiments, a handle (174) is provided on one or both of the inner and outer surfaces (103, 104) for sliding the door (102) open and closed.

Once the door (102) is closed, the lock assembly (100) is employed to secure the door (102) in this position. The lock assembly (100) operates by using an actuator (140) to extend a latch (150) inwardly from the inner surface (103) of the door (102) to engage a catch (116) adjacent thereto in the second side (114) of the doorway opening (110).

Figure 3A:
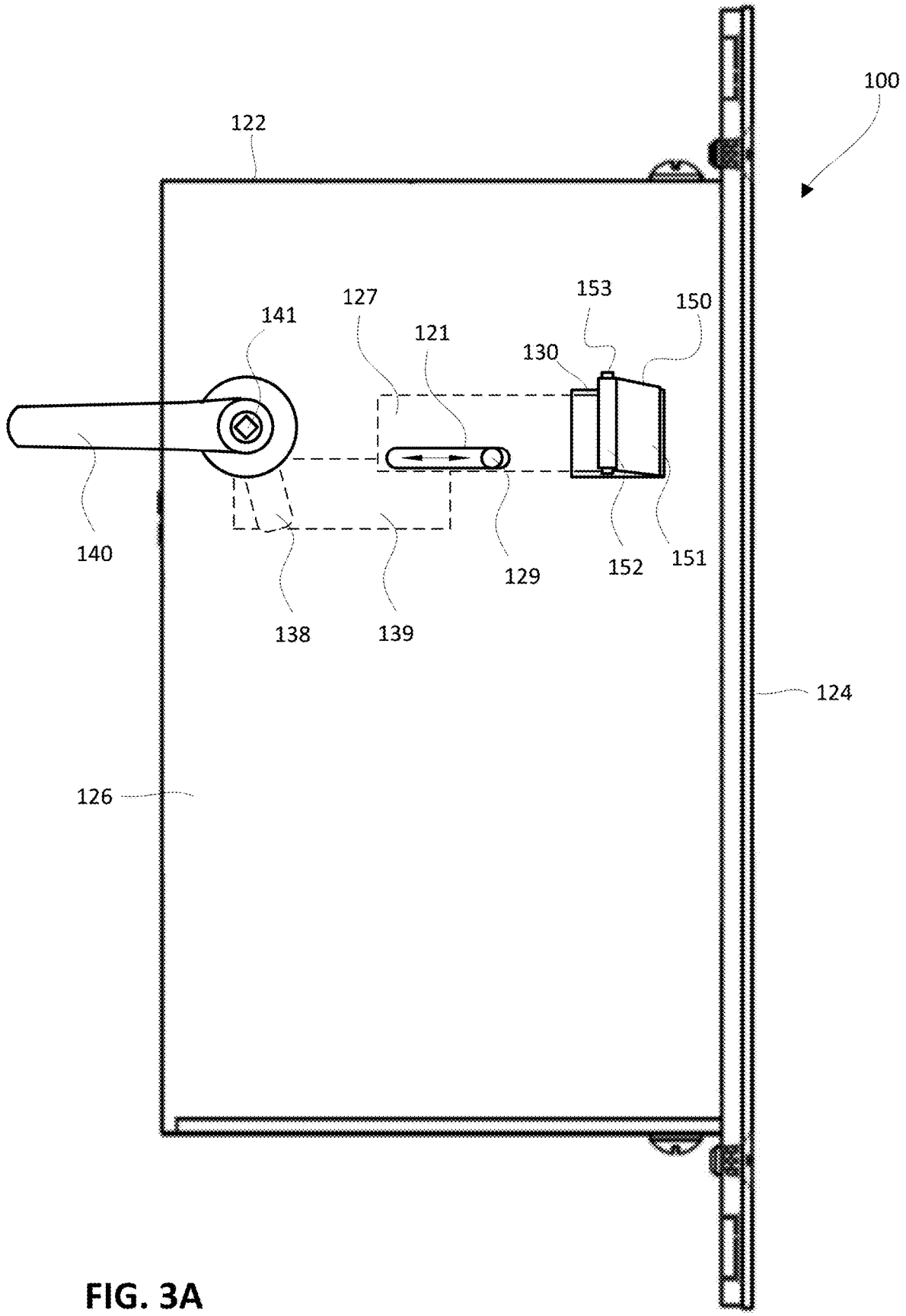
FIG. 3A is side view of the door lock of the system of FIG. 1 with a latch in an extended position.

FIG. 3A is a side view of the lock assembly (100) showing the latch (150) in an extended position, as further described below. The lock assembly (100) includes a housing (122) having a side cover (126) on each side thereof and an end plate (124). In the illustrated embodiment, the side cover (126) conceals a slider (127) within the housing (122), and the side cover (126) has an aperture (121) that accommodates a small protuberance (129) extending outwardly from the slider (127) to glide the lateral movement of the slider (127) within the housing (122).

The lock assembly (100) further includes an actuator (140) that can be manipulated by a user to move the lock between unlocked and locked positions. In FIG. 3A, the actuator (140) is a thumb turn that has been pivoted about a pivot point (141) to a locked position. It should be noted, however, that in other embodiments, the actuator (140) is of a type that is rotatably or slidably manipulated, as further described below.

In the illustrated embodiment, the actuator (140) moves a cam (138) that engages mechanical linkage (139) to move the slider (127) in the direction of the end plate (124).

The lock assembly (100) further includes a latch (150) that, in FIG. 3A, is shown in its extended or thrown position for engagement with the previously referenced receiver or catch (116) located in the wall edge (114) of the doorway opening (110). The latch (150) is hingedly attached at its proximal end (151) to the slider (127) and is moveable through an opening (130) of the housing (122). When the actuator (140) is turned to this locked position such that the slider (127) moves in the direction of the end plate (124)

(i.e., toward the second end (108) of the door), the latch (150) is extended out from the opening (130), as further described below.

Figure 3B:
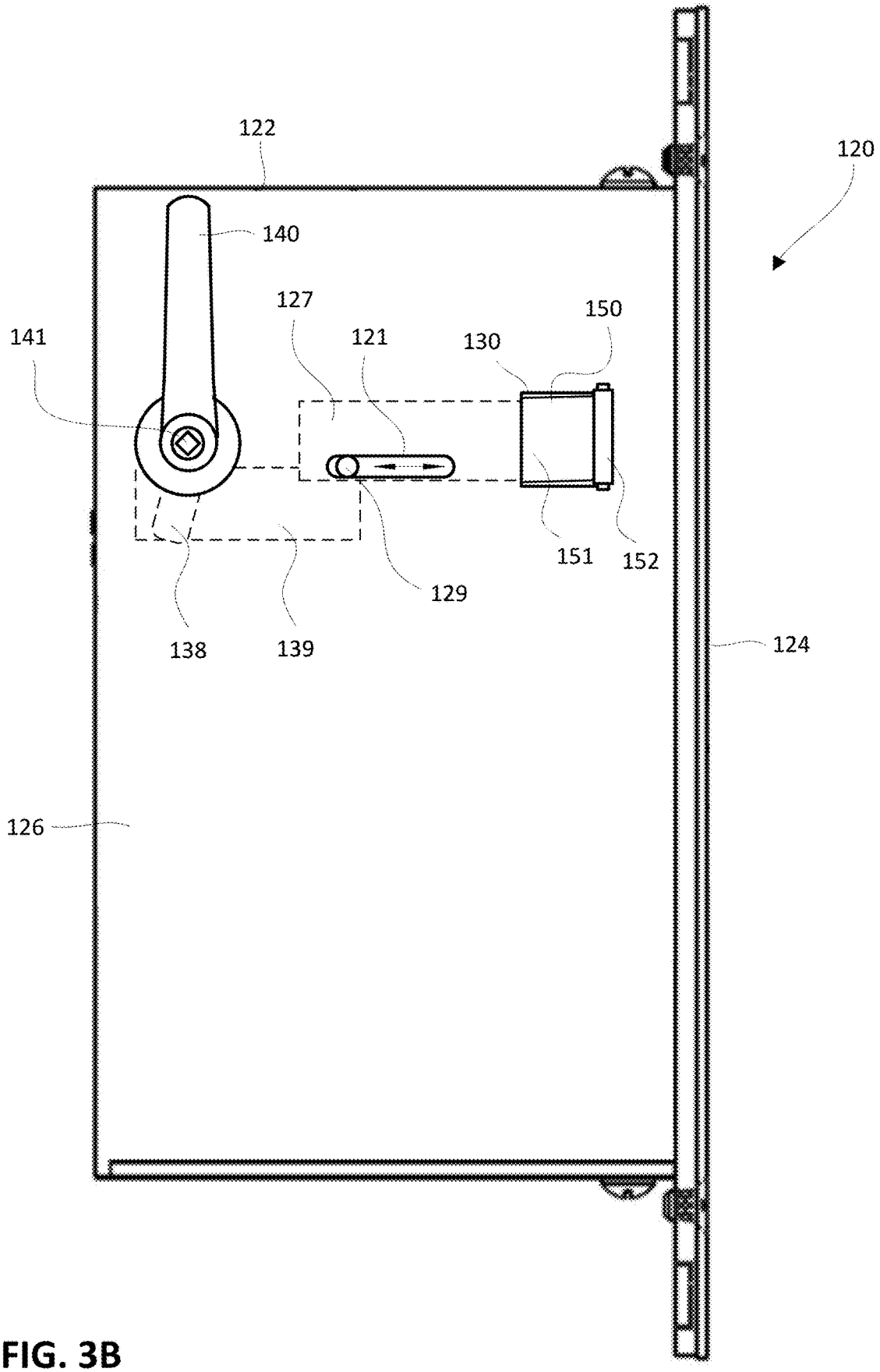
FIG. 3B is side view of the door lock of FIG. 3A with the latch in a retracted position.

FIG. 3B is another side view of the lock assembly (100), in which the latch (150) is in a retracted position. When the actuator (140) is pivoted upward about the pivot point (141) to an unlocked position as shown, the cam (138) again engages the linkage (139) to pull the slider (127) away from the end plate (124) (i.e., toward the first end (106) of the door). As a result, the latch (150) is retracted at least partially into the opening (130), thereby unlocking the door (102), such that it is free to slide.

Figure 4A:
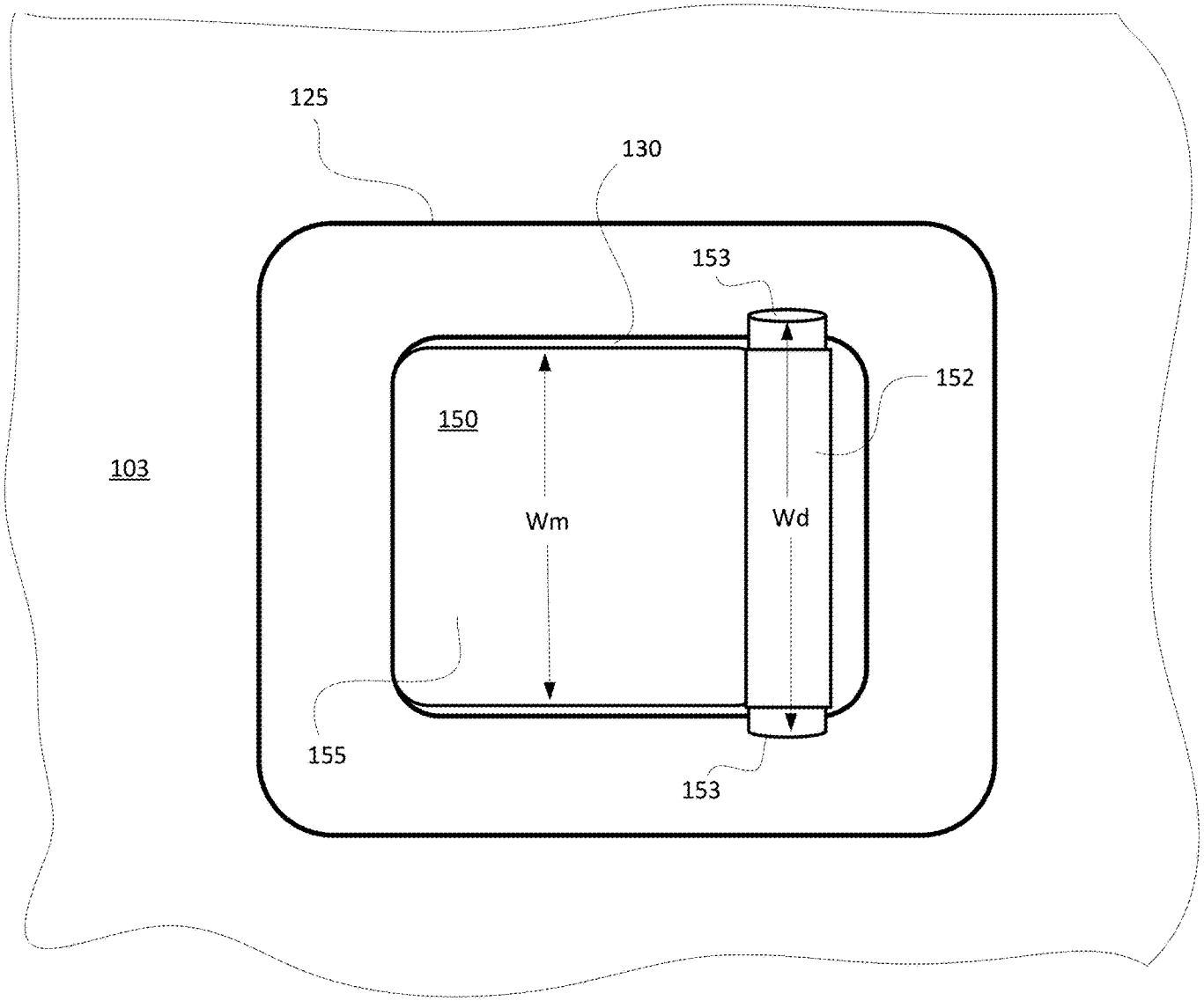
FIG. 4A is a side view of the latch of the sliding door locking system of FIG. 1 mounted to a door in a retracted position.
Figure 4B:
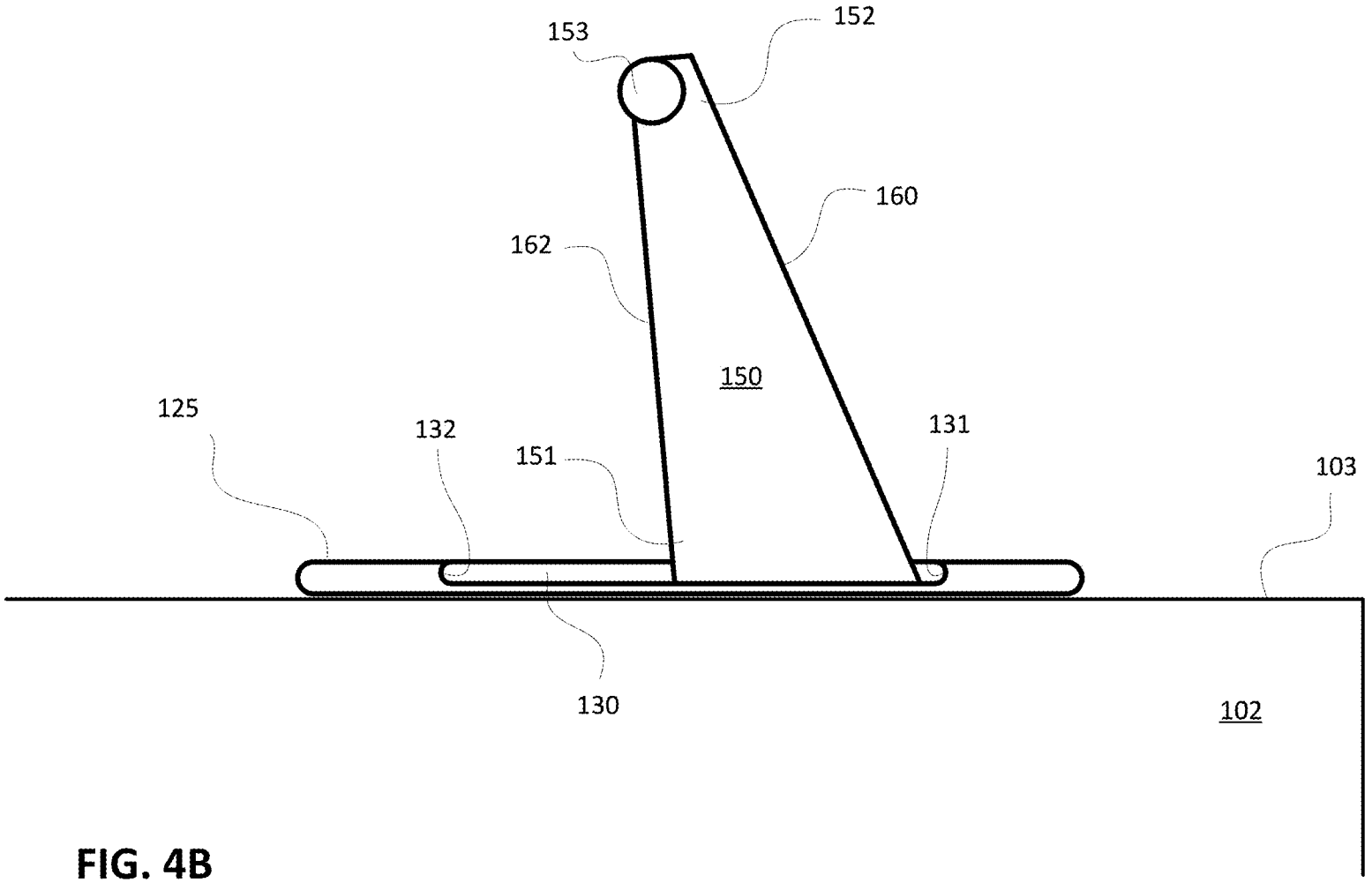
FIG. 4B is a bottom view of the latch of FIG. 4A in an extended position.
Figure 4C:
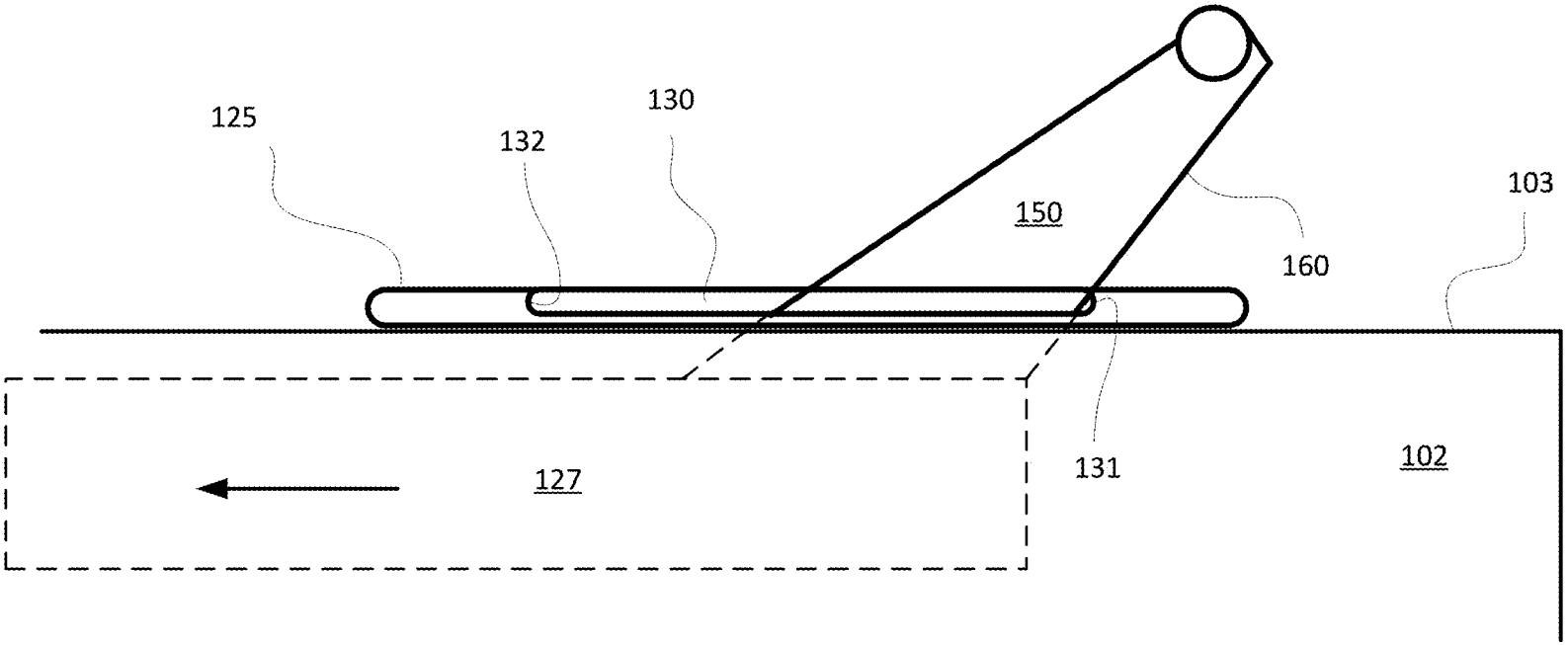
FIG. 4C is a bottom view of the latch of FIG. 4B as it is moving from an extended position to a retracted position.

Referring to FIGS. 4A-C, details of the latch (150) are shown. Referring first to FIG. 4A, illustrated is a latch (150) in a retracted position as seen when looking at the side (103) of a door to which it is mounted. The lock assembly (100) includes a decorative faceplate (125) that resides on the inner surface (103) of the door (102), which provides access to the aperture (130) that passes through the inner surface (103). The latch (150) has a distal end (152) with one or more protrusions or hook features (153). In the exemplary embodiment, the latch (150) has a main portion (155) with a main width $W_m$, proximal of the distal end (152). The distal end (152) has cylindrical protrusions (153) extending out from the top and bottom, such that the main width $W_m$ of the latch (150) is less than the width $W_d$ of the distal end (152) of the latch (150).

FIG. 4B illustrates the latch (150) when in an extended position, and for ease of reference, is shown from a bottom view (i.e., perpendicular to FIG. 4A). The latch (150) includes an inclined surface (160) along its bottom when in the retracted position such that, as the latch (150) slides laterally from the retracted position (FIG. 4A) to the extended position (FIG. 4B), the inclined surface (160) slides along the aperture edge (131), thereby causing the latch (150) to pivot about its proximal end (151) as it slides laterally. When the aperture is subsequently moved from the extended position (FIG. 4B) to the retracted position (FIG. 4A), the latch (150) slides laterally in the opposite direction until the substantially straight surface (162) strikes the opposite aperture edge (132), causing the latch (150) to again pivot (in the opposite direction) about its proximal end (151) so that the inclined surface (160) strikes the aperture edge (131) and then slides along the edge (131) as the latch (150) is withdrawn back through the aperture (130), as shown in FIG. 4C.

Figure 5:
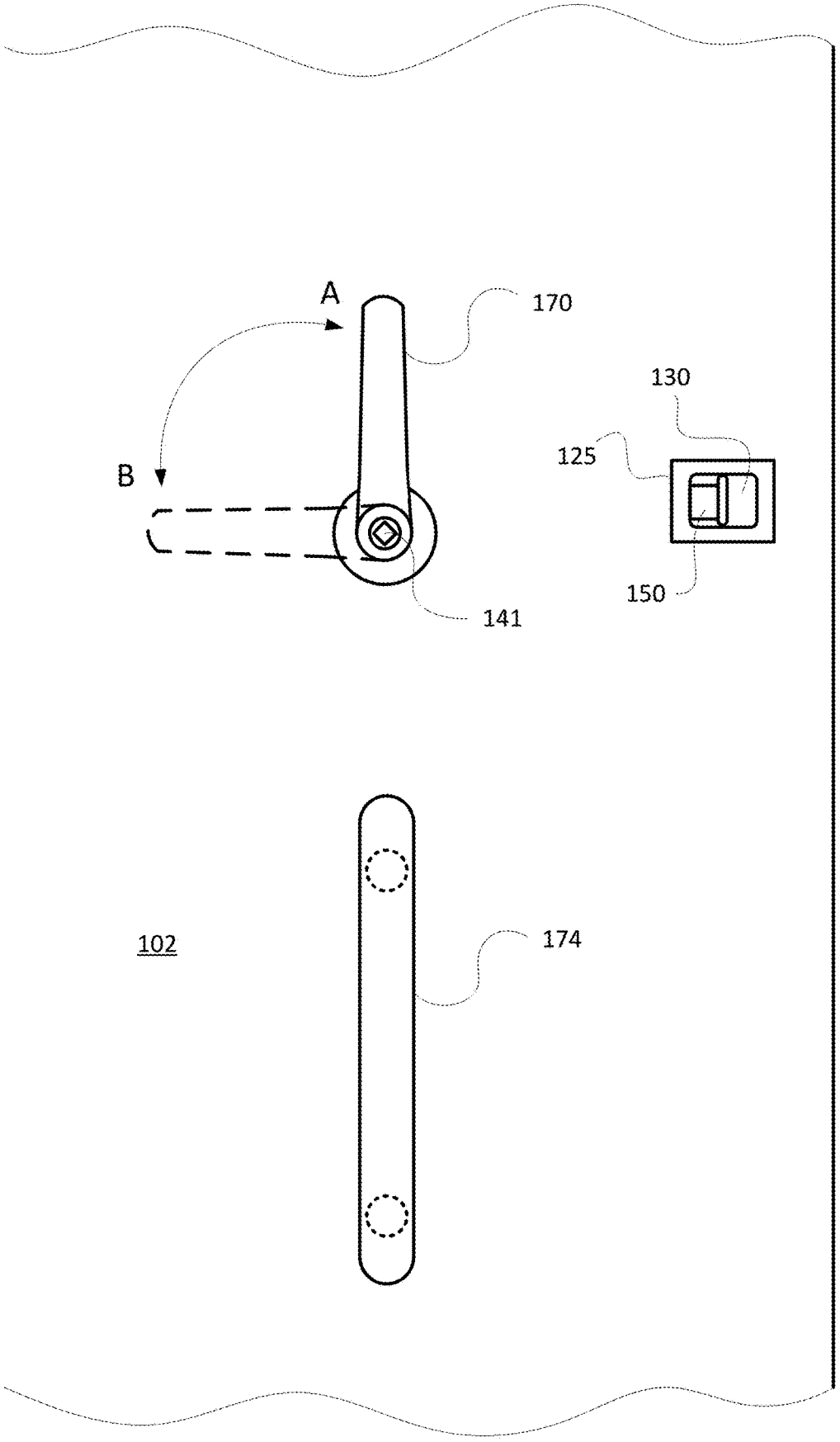
FIG. 5 is a partial side view of the sliding door locking system of FIG. 1 with a thumb turn actuator.
Figure 6:
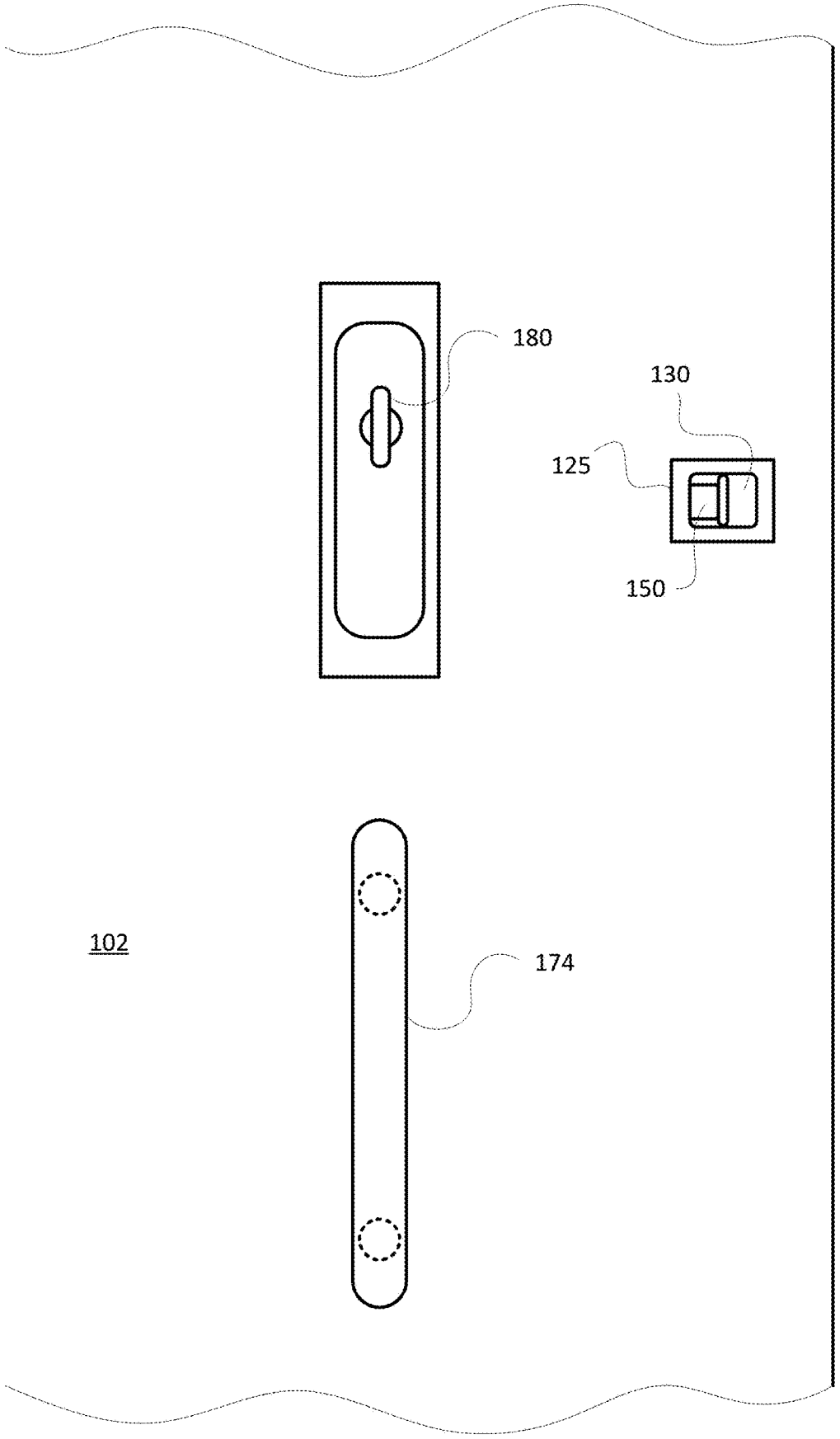
FIG. 6 is a partial side view of the sliding door locking system of FIG. 1 with a recessed T-turn actuator.
Figure 7:
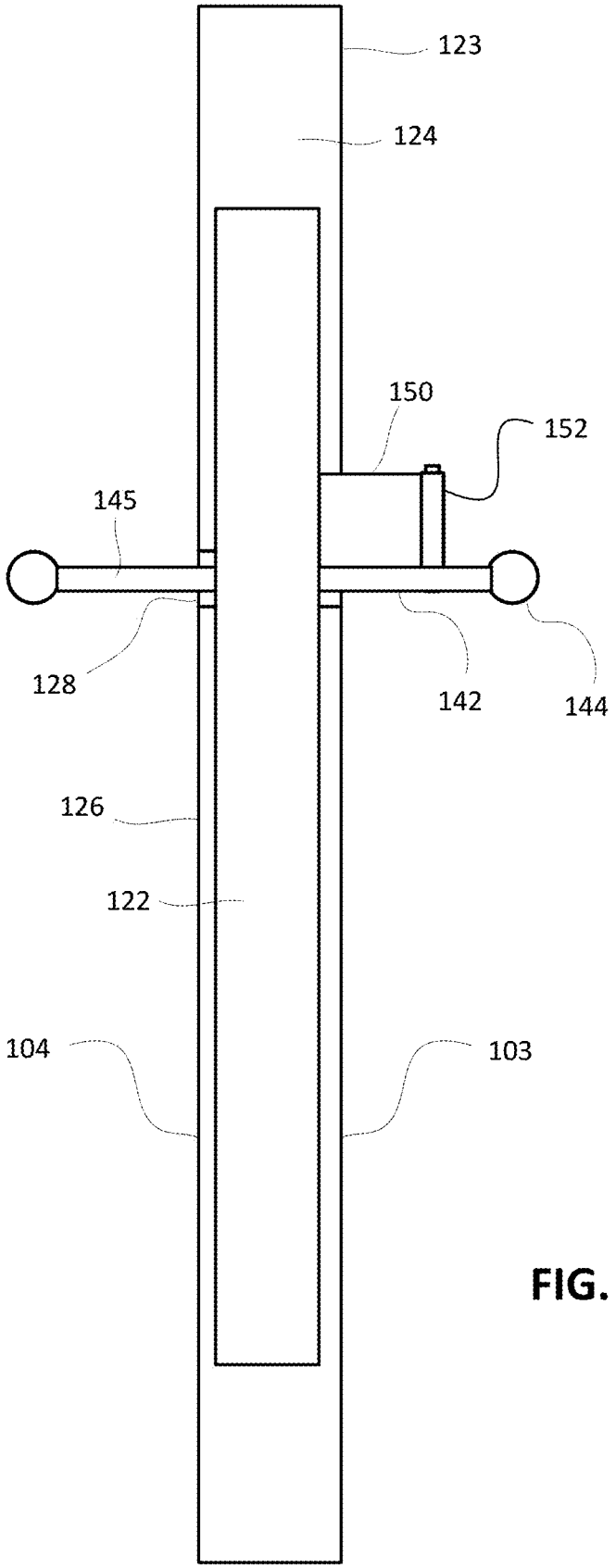
FIG. 7 an exposed rear view of the door lock of FIGS. 3A-B with a sliding actuator on each side of the door.

As shown in FIG. 5, the actuator discussed above is in the form of a thumb turn (170) that pivots about a pivot point (141) to move the latch (150) between an unlocked/retracted position A and a locked/extended position B. However, it should be noted that other devices for causing the latch (150) to move between the retracted and extended positions may be employed. For example, in some embodiments, as illustrated in FIG. 6, the actuator comprises a recessed, rotatable T-turn (180) to move the latch (150) between the unlocked/retracted position and the locked/extended position. In other embodiments, the actuator comprises a slidable rod (145) that moves the latch (150) between the retracted and extended positions, as shown in FIG. 7. In still other embodiments, keyed levers or other slidable, pivotable, or rotatable mechanisms such as those employed in standard mortise locks are employed as the actuator for moving the latch (150).

FIG. 7 illustrates a rear view of the lock assembly (100) previously described with reference to FIGS. 3A-B showing the latch (150) in its extended (or thrown) position. In this embodiment, the depicted actuator (145) is in the form of a rod (142), having a balled end (144) for easy gripping, which slides laterally within the opening (128) in the side cover (126) of the housing (122), as well as a corresponding opening in the door (not shown) for slidable manipulation by the user. Whether the actuator comprises the sliding rod (145) or any of the other aforementioned actuators, an actuator may extend from one or both sides of the housing (122), as illustrated.

When the latch (150) is retracted inwardly towards the housing (122), the latch distal end (152) is retracted at least as far as the outer edge (123) of end plate (124) in order to eliminate the risk of a protruding latch (150) causing injury or damage to structural surfaces as the unlocked door (102) slides.

It should be noted that, in certain embodiments, the actuator (140) may be provided and mounted in the door (102) separately from the housing (122), and then mechanically linked to the latch (150). This may be employed, for example, in cases where it desirable to locate the actuator (140) near the opposite end of the door (102) as the latch (150). In such cases, the actuator (140) may be connected to the latch (150) via, for example, a rod extending along the inside of the door (102) and into the housing (122).

Referring again to FIG. 1, a catch (116) that receives the latch (150) is mounted to the edge (114) of the door opening (110) against which the door (102) closes. As noted above, while in some embodiments, the edge (114) is part of a wall (105) adjacent the doorway opening (110), in other embodiments, the second side (114) is another sliding door. When the sliding door (102) is closed and the lock assembly (100) is adjacent to the edge (114), the lock may be engaged by moving the actuator (140). This extends the latch (150) into the catch (116). The distal end (152) enters the catch (116) and is secured therein such that the door (102) cannot slide or be pulled outwardly away from the edge (114).

Figure 8:
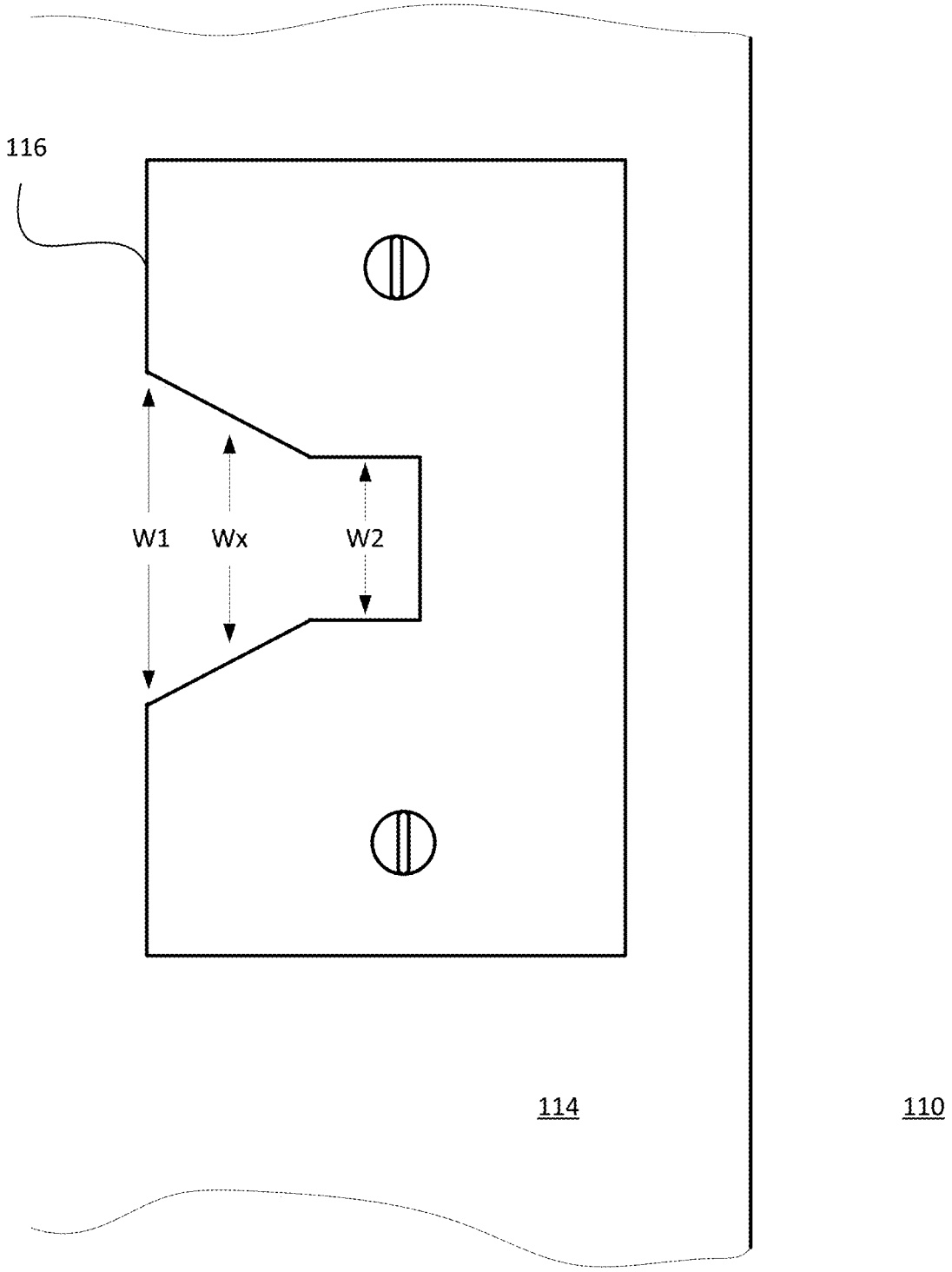
FIG. 8 is a side view of the catch of the sliding door locking system of FIG. 1.

FIG. 8 illustrates an exemplary catch (116) for receiving the latch (150). The catch (116) has a wider section and a narrower section, and in this embodiment, at least part of the catch (116) has a tapered shape. At least part of the wider section has a first width $W_1$ that is not less than the width $W_d$ of the distal end (152) of the latch (150), previously discussed with reference to FIG. 4A. At least part of the narrower section has a second width $W_2$ that is less than the width $W_d$ of the distal end (152) of the latch (150). As a result, the widened distal end (152) of the latch (150) can enter the catch (116) in the wider portion, and then be moved within the catch (116) such that the distal end (152) is then secured behind the narrower portion of the catch (116). It should be noted that, while the wider section has a width $W_1$ that is not less than the width $W_d$ of the latch distal end (152) so that the latch distal end (152) can enter the catch (116), the wider section of the catch (116) may also have additional widths $W_x$ that may be less than the width $W_d$ of the latch distal end (152). In the illustrated embodiment, after the latch distal end (152) enters the widest portion of the catch (116), the latch main portion (155) moves through the tapered portion of the catch (116) until the latch distal end (152) is located behind the narrowest portion of the catch (116).

Figure 9A:
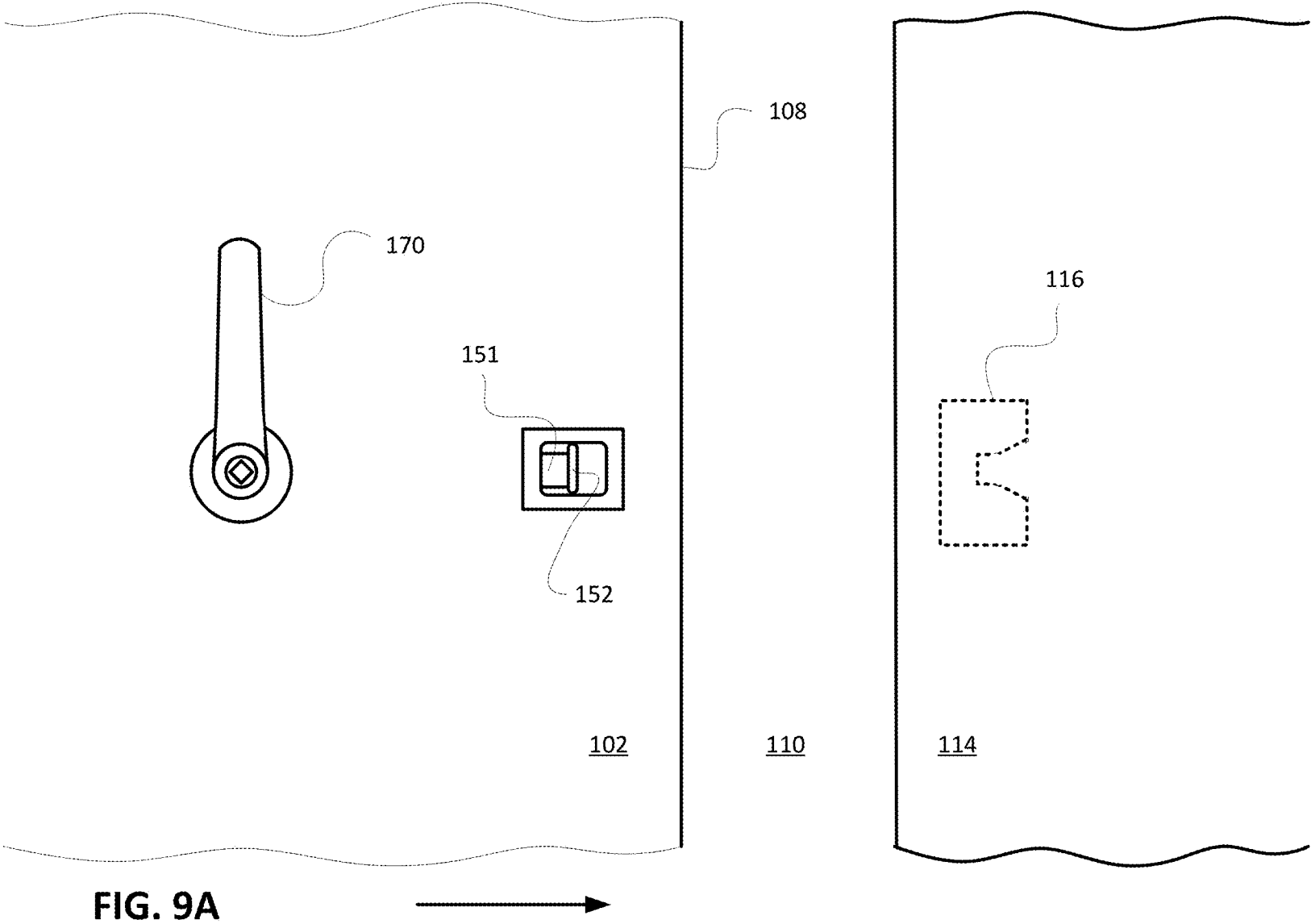
FIGS. 9A-C are partial side views of the locking system of FIG. 5 illustrating the sliding of the door and moving the latch from an unlocked position to a locked position.
Figure 9B:
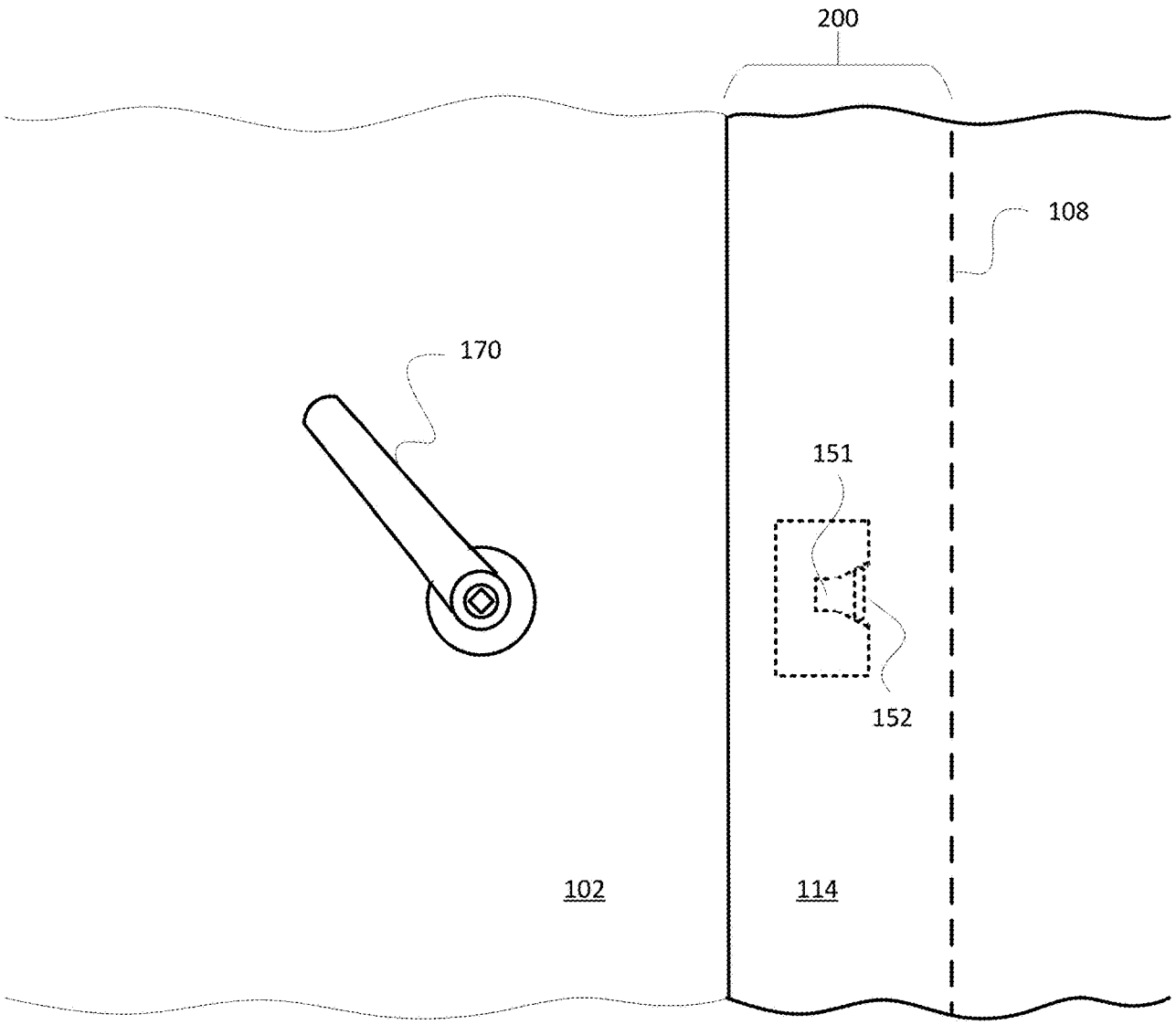
Figure 9C:
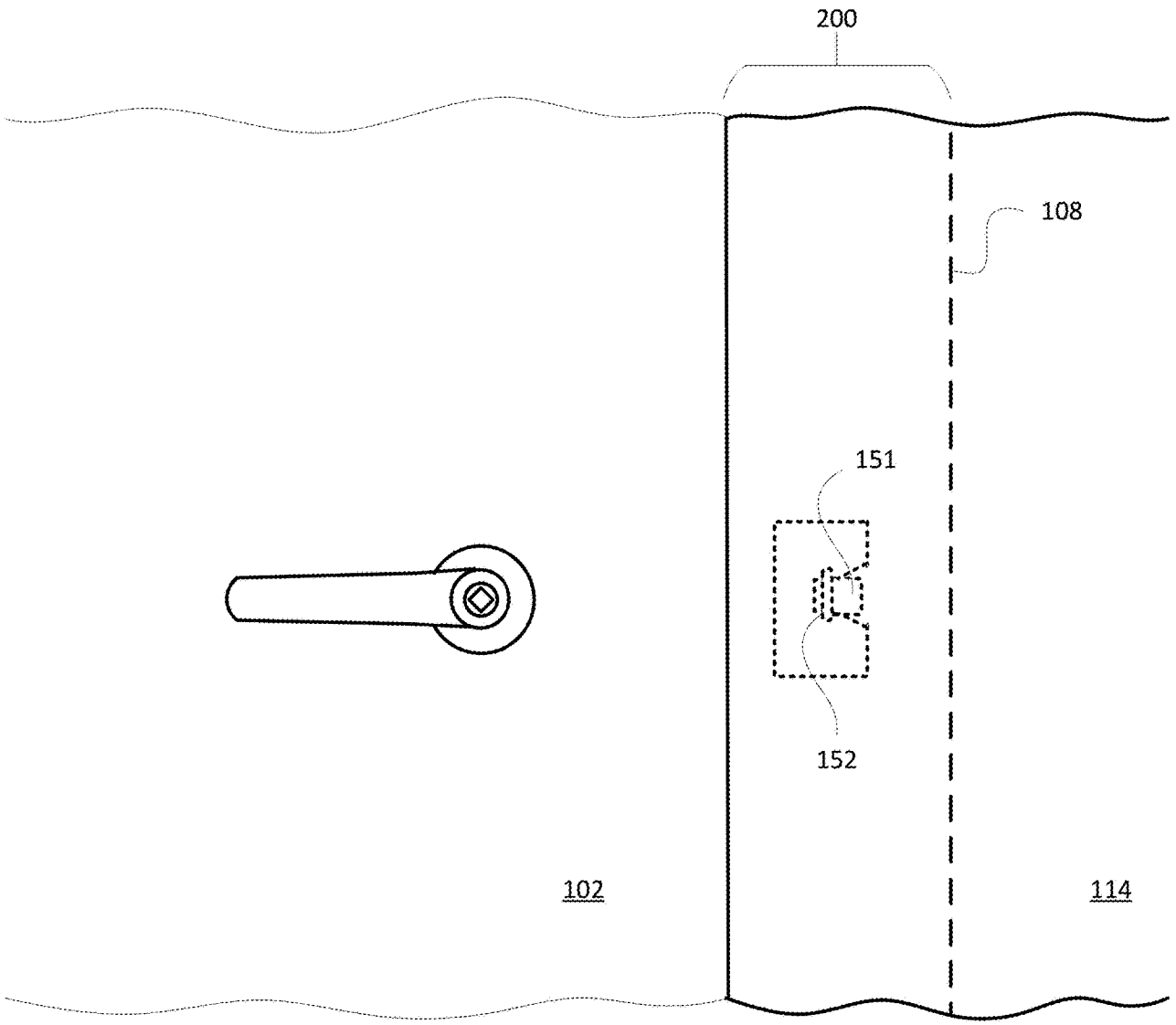

As illustrated in FIGS. 9A-C, in certain advantageous embodiments, the actuator (140) causes the latch (150) to engage the catch (116) by simultaneously moving the latch (150) laterally and pivoting the latch about its proximal end (151) when moving it from an unlocked/retracted position to a locked/extended position. Referring first to FIG. 9A, the wider portion of the catch (116) is located farther away from the door opening (110) than the narrower portion. The door (102) is slid across the doorway opening (110) until the second end (108) closes against the second edge (114) of the doorway.

As shown in FIG. 9B, the door is closed when the end (108) of the door (102) creates an overlap (200) with the second edge (114) of the doorway (110). When a user starts to pivot the lever (170), the proximal end (151) of the latch (150) moves laterally towards the second end (108) of the door (102) as it is pushed in that direction. However, at the same time, the latch (150) pivots about its proximal end (151), such that the distal end (152) moves in the opposite lateral direction as the proximal end (151), back towards the first end (106) of the door (102), while it moves inwardly toward the catch (116), as shown in FIG. 9C. As a result of this motion, the distal end (152) of the latch (150) enters the catch (116) at the wider section, and then moves behind the narrow section of the catch (116), securing the door (102) in a locked position, when the actuator (170) is pivoted fully. By subsequently moving the actuator (170) in the opposite direction, the latch (150) performs the opposite motion, disengaging from the catch (116) and unlocking the door (102).

It should be understood that the actuator, whether a thumb turn (170), T-turn (180), sliding rod (142), or the like, can be mechanically coupled to the latch such that it's effect is the reverse of that described above. In other words, in some embodiments, the actuator moves the latch (150) from a locked/extended position to an unlocked/retracted position (instead of vice versa) when slid or pivoted in the direction described above. Additionally, while the latch (150) is mounted such that it moves through an aperture passing through the inner surface (103) of the door (102), the actuator (140) may be located on either the inner surface (103), outer surface (104), or both.

In some embodiments, a door stop (210) is employed to prevent the door (102) from sliding past a certain point in order to facilitate proper alignment of the latch (150) and catch (116), as shown in FIG. 2. For example, a shoe may be mounted to the floor to catch the bottom of the sliding door, or as another example, the top of the door may be fitted with a rubber stopper to stop the door from sliding along the track (107). Typically, the stop would be positioned to stop the door when there is an overlap (200) of about three inches.

Although the invention has been described with reference to a particular arrangement of parts, features and the like, these are not intended to exhaust all possible arrangements or features, and indeed many modifications and variations will be ascertainable to those of skill in the art.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A sliding door locking system, comprising:

a sliding door having an inner surface that slides over a doorway opening when the door is slidably mounted above the doorway opening, and an outer surface;

a lock housing mounted in the sliding door, the housing having an aperture extending through the inner surface of the sliding door; and a latch hingedly mounted in the aperture such that the latch is moveable from a retracted position, in which the door is slidable along the door opening, and an extended position, in which the latch engages a catch opposite the inner surface of the door and adjacent the doorway opening;

wherein at least one of the inner and outer surfaces of the sliding door includes an actuator that, when moved from a first position to a second position, moves the latch from the retracted position to the extended position.

2. The sliding door locking system of claim 1, wherein:

the latch has a distal end that engages the catch, the distal end having a distal width; and the catch has an opening with a first section having a first width not less than the distal width, through which the distal end of the latch enters the catch as the latch is moved from the retracted position to the extended position, and a second section with a second width less than the distal width, which retains the distal end of the latch in the catch when the latch is in the extended position.

3. The sliding door locking system of claim 2, wherein:

the latch has a main portion proximal of the distal portion, the main portion having a main width less than the distal width;

at least part of the catch opening is tapered; and the main portion of the latch passes through the tapered portion of the catch opening as the latch moves from the retracted position to the extended position.

4. The sliding door locking system of claim 2, wherein the distal portion has a top and a bottom, a first cylinder extending from the top, and a second cylinder extending from the bottom.

5. The sliding door locking system of claim 1, wherein:

the latch has a proximal end within the lock housing and a distal end that engages the catch; and when the latch moves from the retracted position to the extended position, the proximal end moves in a first lateral direction while the latch pivots about the proximal end such that the distal end moves in a second lateral direction opposite the first lateral direction.

6. The sliding door locking system of claim 1, further comprising:

a slider disposed in the lock housing and movable relative thereto;

wherein the latch has a proximal end hingedly coupled to the slider and a distal end that engages the catch.

7. The sliding door locking system of claim 6, wherein the actuator is mechanically linked to the slider such that the slider moves the latch from the retracted position to the extended position when the actuator is moved from the first position to the second position.

8. The sliding door locking system of claim 1, wherein the latch has an inclined surface that slides on an edge of the aperture.

9. The sliding door locking system of claim 1, wherein:

the housing includes an end plate perpendicular to the inner surface; and the latch has a distal end that does not extend out from the inner surface farther than the end plate when the latch is in the extended position.

10. The sliding door locking system of claim 1, wherein the actuator comprises a thumb turn.

11. The sliding door locking system of claim 1, wherein the actuator comprises a T-turn.

12. The sliding door locking system of claim 1, wherein the actuator comprises a sliding member.

13. The sliding door locking system of claim 1, a door stop that prevents the door from sliding at a distance at which the latch and the catch are aligned with each other.

14. A sliding door locking system, comprising:

a lock housing having an aperture therein, the lock housing configured to be mounted in a sliding door such that the aperture extends through an inner surface of the sliding door;

a latch hingedly mounted in the aperture such that the latch moves between a retracted position and an extended position;

a catch configured to be mounted in a surface opposite the aperture of the lock housing such that the latch engages the catch when moved from the retracted position to the extended position;

an actuator configured to be mounted to at least one of the inner surface and an outer surface of the sliding door such that the actuator, when moved from a first position to a second position, moves the latch from the retracted position to the extended position;

wherein the latch has a distal end that engages the catch, the distal end having a distal width; and;

wherein the catch has an opening with a first section having a first width not less than the distal width, through which the distal end of the latch enters the catch as the latch is moved from the retracted position to the extended position, and a second section with a second width less than the distal width, which retains the distal end of the latch in the catch when the latch is in the extended position.

15. The sliding door locking system of claim 14, wherein:

the latch has a main portion proximal of the distal portion, the main portion having a main width less than the distal width;

at least part of the catch opening is tapered; and the main portion of the latch passes through the tapered portion of the catch opening as the latch moves from the retracted position to the extended position.

16. The sliding door locking system of claim 14, wherein the distal portion has a top and a bottom, a first cylinder extending from the top, and a second cylinder extending from the bottom.

17. The sliding door locking system of claim 14, wherein:

the latch has a proximal end within the lock housing and a distal end that engages the catch; and when the latch moves from the retracted position to the extended position, the proximal end moves in a first lateral direction while the latch pivots about the proximal end such that the distal end moves in a second lateral direction opposite the first lateral direction.

18. The sliding door locking system of claim 14, further comprising:

a slider disposed in the lock housing and movable relative thereto;

wherein the latch has a proximal end hingedly coupled to the slider and a distal end that engages the catch.

19. The sliding door locking system of claim 18, wherein the actuator is mechanically linked to the slider such that the slider moves the latch from the retracted position to the extended position when the actuator is moved from the first position to the second position.

20. The sliding door locking system of claim 14, wherein the actuator comprises a thumb turn.

21. The sliding door locking system of claim 14, wherein the actuator comprises a T-turn.

22. The sliding door locking system of claim 14, wherein the actuator comprises a sliding member.

23. The sliding door locking system of claim 14, further comprising a door stop for preventing the door from sliding at a distance at which the latch and the catch are aligned with each other.

24. A sliding door locking system, comprising:

a lock housing having an aperture therein, the lock housing configured to be mounted in a sliding door such that the aperture extends through an inner surface of the sliding door;

a latch hingedly mounted in the aperture such that the latch moves between a retracted position and an extended position;

a catch configured to be mounted in a surface opposite the aperture of the lock housing such that the latch engages the catch when moved from the retracted position to the extended position;

an actuator configured to be mounted to at least one of the inner surface and an outer surface of the sliding door such that the actuator, when moved from a first position to a second position, moves the latch from the retracted position to the extended position; and wherein the latch has an inclined surface that slides on an edge of the aperture.

25. A sliding door locking system, comprising:

a lock housing having an aperture therein, the lock housing configured to be mounted in a sliding door such that the aperture extends through an inner surface of the sliding door;

a latch hingedly mounted in the aperture such that the latch moves between a retracted position and an extended position;

a catch configured to be mounted in a surface opposite the aperture of the lock housing such that the latch engages the catch when moved from the retracted position to the extended position;

an actuator configured to be mounted to at least one of the inner surface and an outer surface of the sliding door such that the actuator, when moved from a first position to a second position, moves the latch from the retracted position to the extended position; and wherein:

the housing includes an inner side through which the aperture passes, and an end plate perpendicular to the inner side; and the latch has a distal end that does not extend out from the inner side farther than the end plate when the latch is in the extended position.

* * * * *